United States Patent [19]

Mutschler et al.

[11] Patent Number: 4,526,210

[45] Date of Patent: Jul. 2, 1985

[54] EASILY REPLACEABLE WEAVING MECHANISM NEEDLE ASSEMBLY

[75] Inventors: Ulrich Mutschler, Caluire; Pierre Caparros, Couzon au Mont D'or; Pierre Mouterde, Chatillon sur Chalaronne; Pierre Frappe, Lyons, all of France

[73] Assignee: Staubli-Versol S.A.R.L., Chassieu, France

[21] Appl. No.: 516,062

[22] Filed: Jul. 22, 1983

[30] Foreign Application Priority Data

Jul. 23, 1982 [FR] France ..... 82 13222

[51] Int. Cl.[3] ..... D03C 3/00

[52] U.S. Cl. ..... 139/59

[58] Field of Search ..... 139/59, 63, 64, 65, 139/68

[56] References Cited

FOREIGN PATENT DOCUMENTS

| | | | |
|---|---|---|---|
| 2533763 | 7/1975 | Fed. Rep. of Germany | 139/59 |
| 2744422 | 10/1977 | Fed. Rep. of Germany | 139/68 |
| 1278744 | 11/1961 | France | 139/59 |
| 593098 | 10/1947 | United Kingdom | 139/59 |

*Primary Examiner*—Henry S. Jaudon
*Assistant Examiner*—Steven Shongut
*Attorney, Agent, or Firm*—Dowell & Dowell

[57] ABSTRACT

It comprises a grid incorporating inclined bars (13) for bending the needles (5) so that they pass above a lateral lug (8*c*) of the corresponding small needle (8) provided to be flat. Each small needle comprises a fine tail (8*b*) guided by a perforated panel (12) on which it rests in the free state by being loaded by the needle (5) which passes through a perforation (11*a*) in a plate (11). The paper (9) is raised in the direction of the small needles with a view to selection.

4 Claims, 9 Drawing Figures

Fig. 3
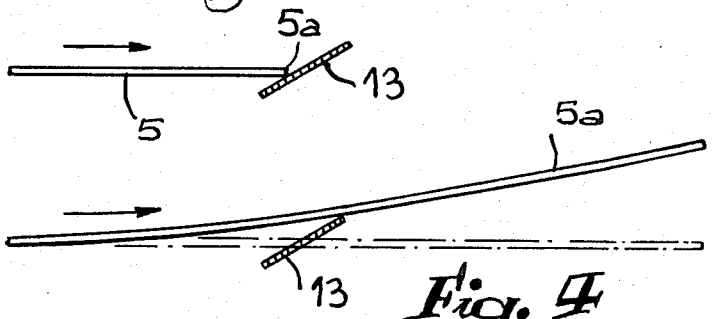
Fig. 4
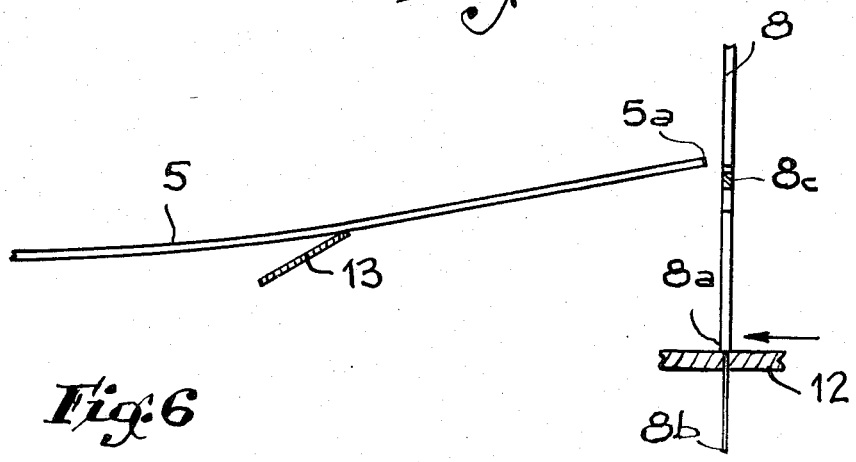
Fig. 6
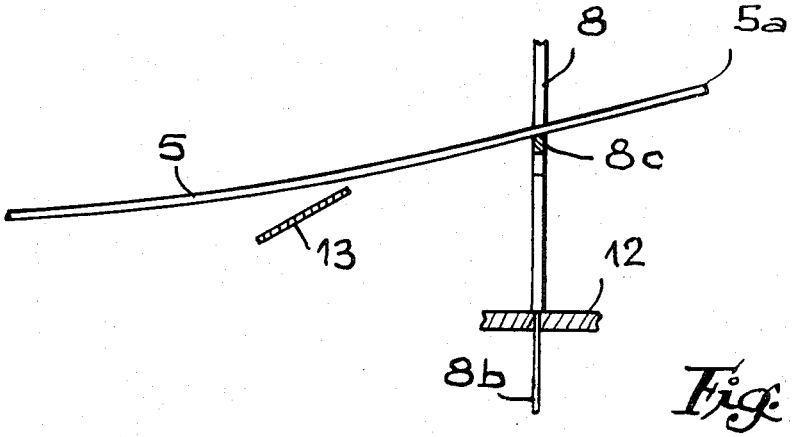
Fig. 5

EASILY REPLACEABLE WEAVING MECHANISM NEEDLE ASSEMBLY

It is known that, in weaving mechanisms of the Verdol type, it is possible to make each needle and stop element assembly in one piece so that the guidings of the latter are eliminated.

Moreover, the needle in one piece may be prestressed upwardly so as to allow elimination of the springs of the small needles.

Such a solution limiting the number of pieces of the assembly enables the cost price thereof to be reduced. However, when it is desired to clean the assembly constituted by the small needles and their guiding, it is necessary to take said assembly out separately and to return it into position by engaging each one-piece needle in the eyelet of the corresponding small needle.

It is readily understood that such an operation is delicate and expensive. It has therefore been thought to simplify the operations so that the assembly of the small needles and their guiding may be dismantled with a view to proceeding with cleaning thereof, then this assembly can be reassembled on the mechanism without having delicate operations to effect.

For the above operations to be effected easily, it is provided to place deflectors against which the needles abut when they are fitted in the mechanism, with the result that they are deviated upwardly, so that they are disposed between two lateral lugs provided on the small needles to replace the conventional loops thereof which are traversed by the needles.

It is necessary that the end of the needle which is or is not to be pushed by the set of bars, passes through the perforations of a vertical guide plate. Reading of the punched paper is effected in the mechanism according to the invention by vertical displacement of the latter in the direction of the small needles. In this way, by replacing the punched paper by a cardboard without holes, all the small needles can be raised upwardly in order to bring the free ends of the needles opposite the perforations of the guide plate and displace it in the direction of the small needles so that the needles engage in said perforations. Finally, the shell supporting the cardboard is lowered so that the needles abut against the lower part of the perforations of the guide plate, by remaining prestressed.

Of course, the arrangement according to the present invention allows a needle to be very easily exchanged. To this end, after withdrawal of the damaged needle, a new one is fitted which passes above the lug of the small needle in question. To cause it to penetrate in the perforation of the guide plate, it suffices to raise the assembly of small needles as indicated previously.

The accompanying drawing, given by way of example, will enable the invention, the characteristics that it presents and the advantages that it may procure, to be more readily understood.

FIG. 1 schematically shows a weaving mechanism applying the improvements according to the invention. This mechanism has been reduced to its most simple expression, i.e. it comprises only one hook, one needle and one small needle.

FIGS. 3 to 9 are schematic views of the different phases of assembly of a weaving mechanism according to the invention.

Figure 1:
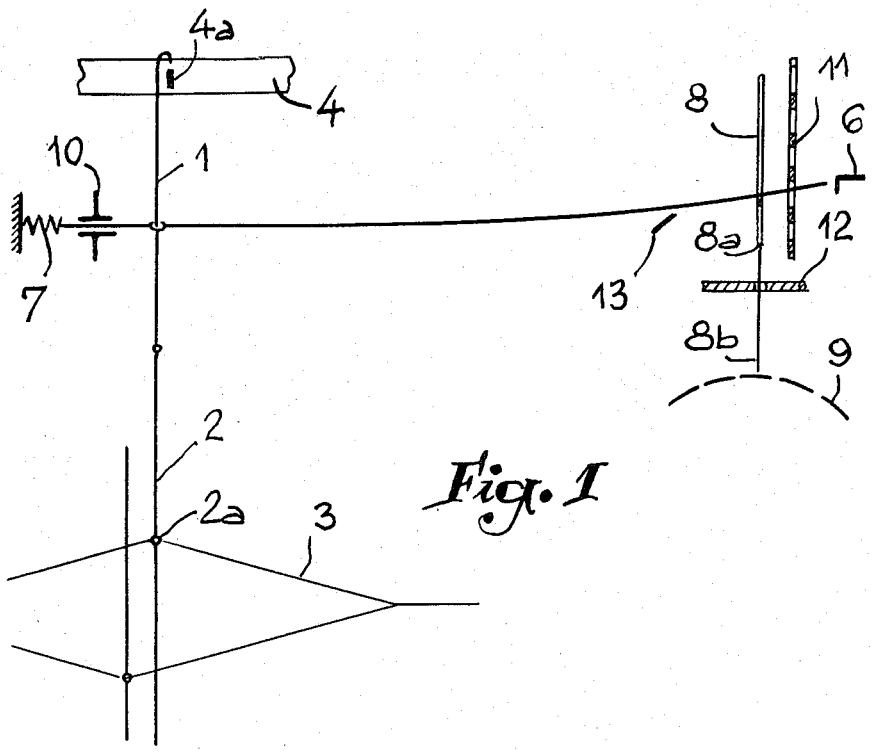

It will be briefly recalled that a weaving mechanism comprises hooks 1 (FIG. 1) whose lower end is fixed to a heddle 2 in the eyelet 2*a* through which passes a warp yarn 3 which is moved upwardly or downwardly to allow passage of a pick.

The hook is raised or lowered by a gripper frame 4 whose blades 4*a* grip the hook, or not, depending on whether the latter is in its normal position or in an offset position produced by an axial displacement of a needle 5 pushed by a bar 6 against the reaction of the spring 7. This axial displacement of the needle 5 which is called the "press" in the weaving technique, is produced as a function of the position of a small needle 8 of which the lower end cooperates with a perforated paper 9. In the example illustrated, the needle 5 is in one piece, its two ends being guided in perforations of two guide plates 10, 11, respectively.

The small needles 8 are elastically loaded downwardly via the needle 5 which possesses a certain elasticity as it is upwardly prestressed as will be explained in greater detail hereinafter. At rest, they abut via a shoulder 8*a* against a horizontal panel 12 whose perforations they traverse.

When it is desired to read a punched paper, the latter is raised in the direction of panel 12. When the small needles abut on this paper at a point where there is no perforation, they are raised so as to bring the free end 5*a* of the needle 5 opposite the bar 6. On the contrary, if the small needle drops opposite a hole, it is not actuated and the corresponding bar 6 moves in the direction of the hook without acting on the needle.

Each of the small needles is advantageously made in the form of a flat section whose lower part carries a cylindrical small-diameter tail 8*b*, whilst it comprises a lateral lug 8*c* whose upper edge is provided with a concave notch 8*d*.

To effect prestressing of each needle 5, the mechanism according to the invention is provided with a grid comprising one or more bars 13, each bar constituting an inclined plane for reasons which will be explained in greater detail hereinbelow.

Figure 2:
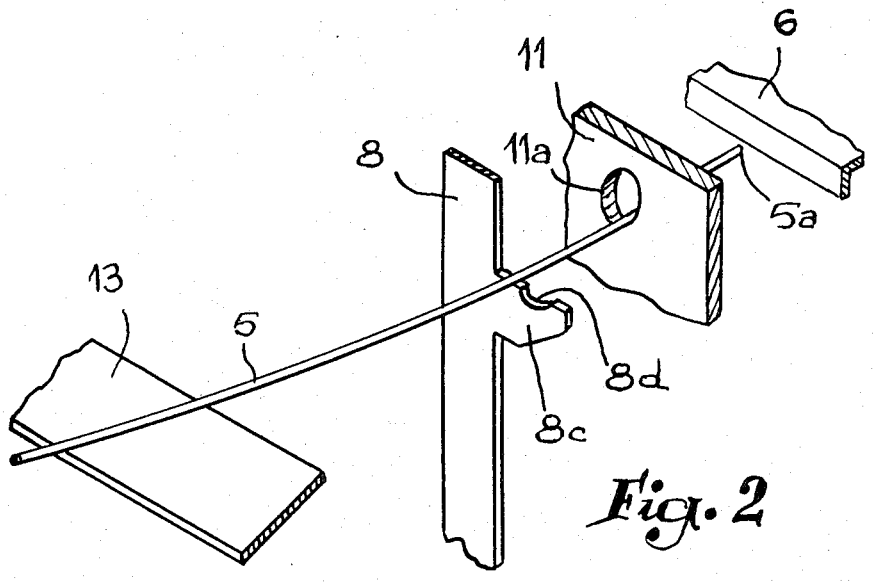
FIG. 2 illustrates in perspective the different essential pieces of the weaving mechanism according to the invention.

FIG. 2 shows a needle 5 in rest position, its free end 5*a* being located below the bar 6, whilst the prestress of said needle is maintained by cooperation with the lower part of the perforation 11*a* of the guide plate 11.

To effect positioning of each needle, it is introduced into the mechanism from the corresponding guide of the plate 10, so that its free end 5*a* abuts against the inclined bar 13, which, acting as deflector, curves the needle upwardly when one continues to insert it, to cause it to undergo an axial displacement (FIGS. 3 and 4).

The inclination of the bar 13 is such that when the end 5*a* arrives near the corresponding small needle 8, it passes above its lateral lug 8*c* (FIG. 5). In this Figure, the rest position of the small needles is observed in which the shoulder 8*a* of each of them is in abutment against the panel 12.

If the assembly constituted by the small needles and their guide member is located in position as illustrated in FIG. 6, the continuation of the axial rightward, displacement of the needle cause it to contact the notch 8*d* of the lug 8*c*, so that it is further curved upwardly.

Moreover, when the needles are in place, curved upwardly by the bars 13, it is possible to install the assembly of the small needles 8 in the mechanism since their lateral lugs 8*c* come respectively into position below the corresponding needle 5. A subsequent displacement of the needles rightwardly of bars 13 provokes additional upward curving of the needles 5 as illustrated in FIG. 5.

When this phase of assembly is arrived at, a non-perforated cardboard 14 is placed below the small needles 8 on the conventional shell of the mechanism which allows the punched paper to slide.

Figure 7:
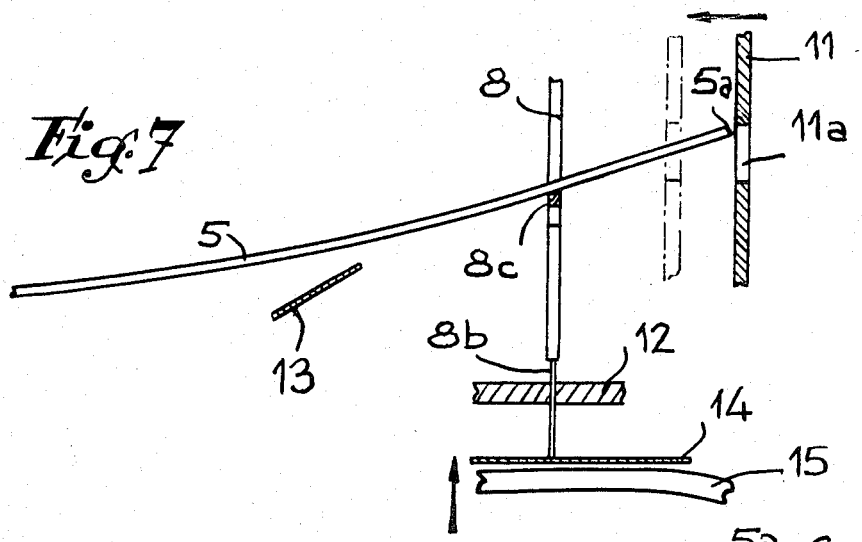

This shell is provided to be movable alternately in upward and downward direction, as selection is effected in a mechanism according to the invention by displacement of the paper in the direction of the small needles. Since this latter has been replaced by a non-perforated cardboard, an upward displacement of the shell 15 causes the raising of all the small needles so that they provoke a supplementary upward bending of the needles 5 (FIG. 7).

The free end 5*a* then comes opposite the perforations 11*a* of the guide plate 11. There again, there are two possibilities. In the first, the guide plate is in position as well as the assembly of the small needles, and the raising of the shell 15 is effected before the axial displacement of the needles has terminated.

According to the other hypothesis, the needles are positioned before the small needles and, in this case, the guide plate 11 is made to undergo a translation towards the left, in FIG. 6, in order to engage the needles in its perforations 11*a*.

Figure 8:
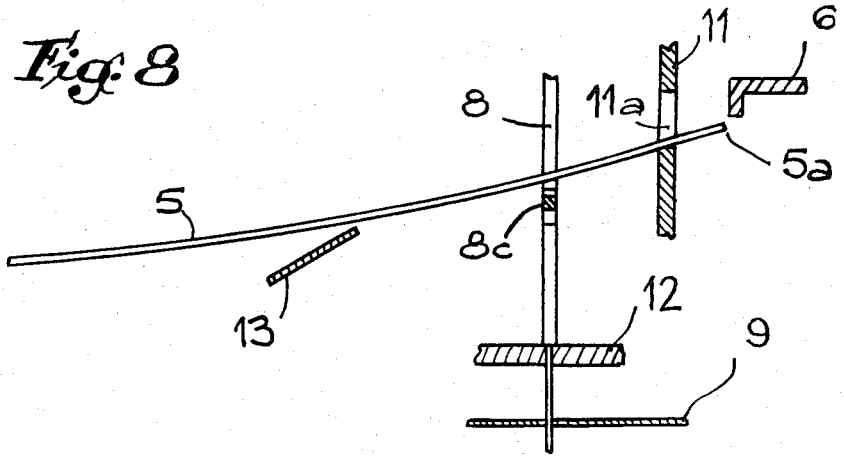

FIG. 8 illustrates the position of the different elements of a weaving mechanism according to the invention when the small needles 8 are in rest position or when they drop opposite a perforation in the paper 9. It is observed that, in this read position, the end 5*a* of the needle 5 is out of alignment with the bar 6 which, at each selection, moves towards the left.

Figure 9:
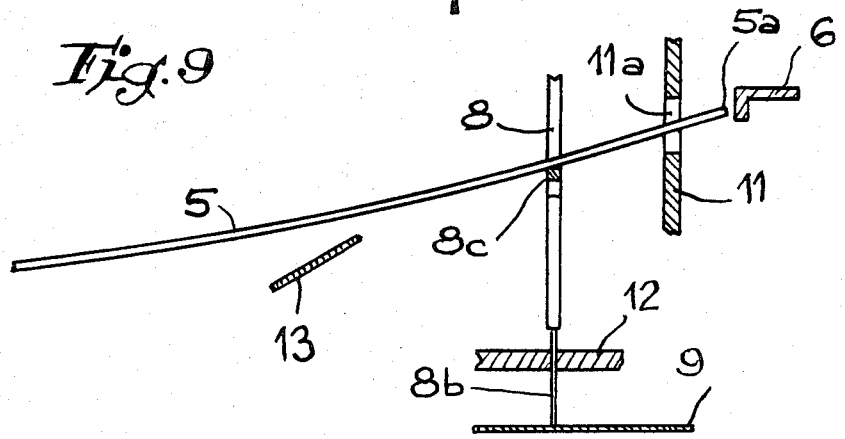

On the contrary, in the position illustrated in FIG. 9, the small needle 8 does not drop opposite a hole in the paper 9 so that it is raised, with the result that the free end 5*a* of the needle 5 comes opposite the bar 6 whose displacement will bring about a translation of the needle 5 and the "press " of the hook 1 (FIG. 1).

It is observed that in FIG. 8 it is the guide plate 11 which determines the position of the needle since the latter is in abutment against the low part of the corresponding perforation 11*a*.

Due to this arrangement, the panel 12 is not loaded downwardly, since the lugs 8*c* of the small needles 8 are located very slightly below the needle 5. On the contrary, when the small needle is raised by the paper, it cooperates virtually immediately with the needle 5, via its lug, said needle constituting the means for downward return of the small needle when the paper is lowered again.

Apart from the ease of assembly of the combination of the small needles and of the plate for guiding the needles, even when the latter remain in position the replacement of one or more needles without displacing the other elements of the mechanism may be easily effected, as explained above.

It must, moreover, be understood that the foregoing description has been given by way of example and that it in no way limits the domain of the invention which would not be exceeded by replacing the details of execution described by any other equivalents.

We claim:

1. Weaving mechanism of the Verdol type of which the needles controlling the press of the hooks are made in one piece and pass through vertical guide plates, characterized in that it comprises:

a grid whose inclined bars (13) constitute deflectors intended to bend the needles (5) upwardly;

flat small needles (8) each comprising a lateral lug (8*c*) adapted to cooperate with the corresponding needle (5) and which are extended by a fine tail (8*b*) of which the attachment to the small needle forms a shoulder (8*a*);

a perforated panel (12) which the tails (8*b*) of the small needles (8) traverse, their shoulders (8*a*) resting against said panel (12);

a plate (11) for guiding the needles (5) which are in abutment against the lower part of its perforations (11*a*);

and a mechanism (15) for driving the paper (9) and which is provided with means for displacing it in reciprocating motion in the vertical direction.

2. Weaving mechanism according to claim 1, characterized in that the lateral lugs of the small needles are offset in height and in that their upper edge comprises a notch adapted to receive the corresponding needle.

3. Process for assembly of the needles (5) of a weaving mechanism characterized in that it consists:

in engaging the needles (5) horizontally by making them cooperate with the bars of the positioning grid (13) which deforms them upwardly so that each of them is placed above the lateral lug (8*c*) of the corresponding small needle (8);

in disposing a non-perforated paper (14) under the small needles (8) and in raising it by means of a rising shell (15) in order to dispose the free ends (5*a*) of the needles opposite the perforations (11*a*) of the guide plate (11) by cooperation of the latter with the lateral lugs (8*c*) of the needles (8) which are raised;

in axially displacing the needles (5) in order to introduce them in the perforations (11*a*) of the guide plate (11);

and in redescending the shell (5) to extract the non-perforated paper.

4. Process of assembly according to claim 3, characterized in that it consists:

in resting the small needles (8) by their shoulder (8*a*) against a perforated panel (12) which their tail (8*b*) traverses;

in introducing the assembly in the mechanism, the lugs (8*c*) of the small needles raising the needles (5);

in disposing a non-perforated paper (14) beneath the small needles (8) and in raising it by means of a rising shell (15) in order to dispose the free ends (5*a*) of the needles opposite the perforations (11*a*) of the guide plate (11) by cooperation thereof with the lateral lugs (8*c*) which are raised;

in inserting thereafter the guide plate (11) of the needles (5), by having its perforations (11*a*) traversed by said needles which in final position of said plate (11) are raised by the bottom of said perforations (11*a*).

and finally in positioning the set of bars (6).

* * * * *